US010370133B2

(12) United States Patent
Baker et al.

(10) Patent No.: US 10,370,133 B2
(45) Date of Patent: Aug. 6, 2019

(54) VACUUM PACKING MONITORING AND CONTROL SYSTEM

(71) Applicant: SF INVESTMENTS, INC., Wilmington, DE (US)

(72) Inventors: Michael Baker, Dunn, NC (US); Russell Martin, Jacksonville, NC (US)

(73) Assignee: SF Investments, Inc., Wilmington, DE (US)

( * ) Notice: Subject to any disclaimer, the term of this patent is extended or adjusted under 35 U.S.C. 154(b) by 729 days.

(21) Appl. No.: 14/828,002

(22) Filed: Aug. 17, 2015

(65) Prior Publication Data

US 2017/0050754 A1 Feb. 23, 2017

(51) Int. Cl.
*B65B 31/02* (2006.01)
*B65B 57/00* (2006.01)
*B65B 57/18* (2006.01)

(52) U.S. Cl.
CPC ..... *B65B 31/02* (2013.01); *B65B 31/022* (2013.01); *B65B 57/00* (2013.01); *B65B 57/18* (2013.01)

(58) Field of Classification Search
CPC ..... B29C 66/00; B65B 31/00; B65B 57/00
USPC ..... 53/53, 432, 508, 510, 512
See application file for complete search history.

(56) References Cited

U.S. PATENT DOCUMENTS 3,958,391 A * 5/1976 Kujubu ..... B65B 31/022 53/434
4,640,081 A * 2/1987 Kawaguchi ..... B65B 9/067 198/463.3
4,691,496 A * 9/1987 Anderson ..... B65B 57/10 141/144
4,845,927 A * 7/1989 Rapparini ..... B65B 31/022 53/511
4,941,306 A * 7/1990 Pfaffmann ..... B29C 65/3656 156/379.7
4,984,414 A * 1/1991 Pfaffmann ..... B29C 65/3656 156/69
4,996,826 A * 3/1991 Pfaffmann ..... B29C 65/3656 156/69
5,033,254 A * 7/1991 Zenger ..... B65B 31/006 53/431
5,062,252 A * 11/1991 Kupcikevicius ..... B65B 31/022 53/374.8
5,675,074 A 10/1997 Melvin, II
5,752,369 A * 5/1998 Suga ..... B65B 31/022 53/493
6,305,148 B1 * 10/2001 Bowden ..... B65B 11/025 206/386

(Continued)

OTHER PUBLICATIONS

International Search Report and Written Opinion of the International Searching Authority for International Application No. PCT/US16/46133, dated Nov. 3, 2016.

*Primary Examiner* — Gloria R Weeks
*Assistant Examiner* — Patrick B Fry
(74) *Attorney, Agent, or Firm* — Reed Smith LLP; Matthew P. Frederick; Cheryl L. Gastineau

(57) ABSTRACT

A system and method for monitoring the performance of a product vacuum packaging machine allows for a determination of the performance of platen and chamber combinations, especially in systems using multiple platens and chambers, and particularly where individual platens are used in combination with differing chambers during packaging operations.

19 Claims, 8 Drawing Sheets

(56) References Cited

U.S. PATENT DOCUMENTS

| | | | | |
|---|---|---|---|---|
| 6,345,487 | B1 * | 2/2002 | Luciano | B65B 35/08 53/147 |
| 6,539,689 | B1 * | 4/2003 | Yoshimoto | B65B 31/022 53/434 |
| 6,834,472 | B2 * | 12/2004 | Kujubu | B65B 25/064 53/255 |
| 6,862,867 | B2 * | 3/2005 | Cady | B29C 65/18 53/432 |
| 7,247,010 | B2 * | 7/2007 | Victorov | A61J 3/07 425/112 |
| 7,296,390 | B2 | 11/2007 | Koke et al. | |
| 7,302,784 | B2 * | 12/2007 | Harges | B29C 65/18 53/434 |
| 7,328,556 | B2 * | 2/2008 | Taylor, Sr. | B29C 65/18 53/375.3 |
| 7,409,811 | B2 * | 8/2008 | Buchko | B65B 31/022 137/627.5 |
| 7,575,114 | B2 * | 8/2009 | Buchko | B65G 15/64 198/689.1 |
| 7,886,692 | B2 * | 2/2011 | Stellnert | A01J 5/007 119/14.08 |
| 8,069,637 | B2 * | 12/2011 | Taylor, Sr. | B29C 65/18 53/375.3 |
| 8,615,973 | B2 * | 12/2013 | Mondry | B65B 9/04 53/432 |
| 2002/0161467 | A1 * | 10/2002 | Hashiguchi | G05B 23/0229 700/116 |
| 2004/0060262 | A1 * | 4/2004 | Harges | B29C 65/18 53/434 |
| 2008/0127614 | A1 | 6/2008 | Taylor | |
| 2011/0271650 | A1 * | 11/2011 | Ehrmann | B65B 31/028 53/510 |
| 2013/0180210 | A1 | 7/2013 | Hammad | |

* cited by examiner

1st and 2nd Stage Vacuum Readings

VACUUM PACKING MONITORING AND CONTROL SYSTEM

BACKGROUND

Vacuum packaging provides an efficient method of packaging many products, including foodstuffs. The use of vacuum packaging can increase the shelf like of packaged foodstuffs by removing the air from the packaging, as well as reducing the volume of the packaged product.

Many individual machines are available to assist in the vacuum packaging of products, from a variety of sources. Each of these machines follows a basic pattern: product is placed within packing material, which is often a thermoformable plastic film, air is evacuated from the within the packing material, and the packing material is sealed around product.

In order for commercially significant amounts of vacuum packaged product to be efficiently produced, mass production equipment has been developed by vendors to implement vacuum packaging on a mass scale. Such equipment typically follows several stages, which include a stage for placing product within packaging, loading the product/packaging combination into a vacuum chamber, drawing a vacuum in the vacuum chamber to remove air from the packaging, using a heated bar to melt edges of the packaging together to seal the package, trimming the packaging materials to minimize packaged product volume, and placing the packaged product onto a conveyor for aggregation into further containers.

Drawing the vacuum in the package tends to take the greatest amount of time, as vacuum pumps are typically used to reduce the air pressure in the vacuum chamber. Accordingly, mass production equipment may use a carousel of vacuum chambers to increase the utilization time for drawing a vacuum in each vacuum chamber.

The vacuum chamber itself may be formed from two components, commonly referred to as the platen and the chamber cover, with the platen forming the stage or platform on which product in unsealed packaging is placed, and the chamber cover forming an air tight cover over the platen after product has been placed on the platen. The combined platen/chamber cover may typically also be provided with an air-tight connection for connecting the combined chamber cover/platen (when combined referred to as the "vacuum chamber") to one or more vacuum pumps for drawing air from the vacuum chamber, and thereby from within the packaging containing the product at the same time. The vacuum chamber may additionally be provided with a means for sealing the packaging under vacuum, such as a heated metal element for melting the packaging to form a seal to prevent air from re-entering the packaging when the package is removed from the vacuum chamber.

In order to address the longer "stay time" of the vacuum chamber during the vacuum stage, multiple vacuum chambers are typically implemented, often from different platen and chamber cover combinations. The ability of the vacuum chambers to hold a vacuum is critical to the efficiency of the machine in packaging product, i.e., product which is not subjected to an adequate vacuum prior to sealing may need to be rejected, resulting in wastage. Detection of sealing problems is critical. Having sealing problems can result in large amounts of sub-standard product being distributed to consumers or being wasted as a result of rejection, prior to a problem being discovered, and may also result in significant down time for the product equipment in order for deficiencies to be diagnosed and corrected.

SUMMARY OF THE INVENTION

To improve the efficiency with which vacuum packaging equipment having multiple vacuum chambers can be utilized, a monitoring and management system has been developed, which utilizes the achieved vacuum for each individual cycle of the vacuum packaging device to identify both problematic product/package units, as well vacuum chambers and vacuum chamber cover/platen combinations, to allow for rapid identification of problems during production, thereby allowing management of the system to achieve the most efficient implementation of the vacuum packaging equipment.

In one aspect the present invention is directed to a monitoring system for a vacuum packaging machine having a plurality of platens and chamber covers and a vacuum pump for pumping air from vacuum chambers formed from platens and chamber covers. The monitoring system may have a vacuum sensor for measuring the pressure level achieved in a vacuum chamber formed from a platen and a chamber cover. The monitoring system may also have a platen identifier for identifying a platen being used to form a vacuum chamber to which the vacuum sensor was connected, as well as a chamber cover identifier for identifying a chamber cover being used to form the vacuum chamber to which the vacuum sensor was connected. The monitoring system may also have a data logger for recording the vacuum achieved in a vacuum chamber for each platen and chamber cover combination joined to form a vacuum chamber.

DETAILED DESCRIPTION OF THE INVENTION

Certain terminology is used in the following description for convenience only and is not limiting. Unless specifically set forth herein, the terms "a," "an" and "the" are not limited to one element but instead should be read as meaning "at least one." The terminology includes the words noted above, derivatives thereof and words of similar import.

Figure 1:
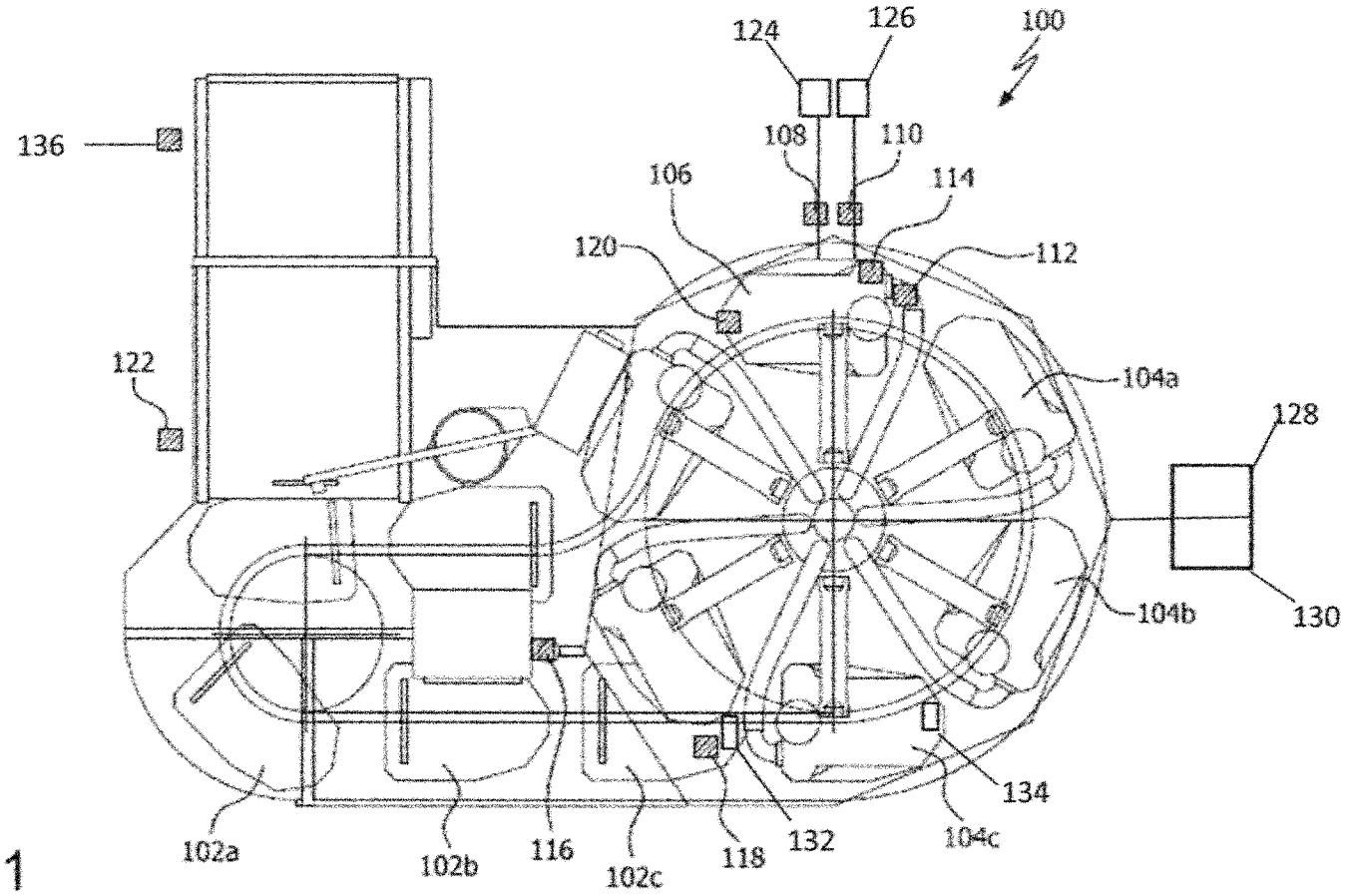
FIG. 1 is an overhead view of a six chamber cover, ten platen vacuum packaging system incorporating a sensor system according to an embodiment of the present invention.

As shown in FIG. 1, a controller system 128 can be connected to vacuum packaging equipment 100. The vacuum packaging equipment 100 may comprise a plurality of platens 102 *a, b, c*, . . . and chamber covers 104 *a, b, c* which may be combined to form individual vacuum chambers 106. The number of platens 102 and chamber covers 104 may or may not be equal, such that different platens 102 may be combined with different chamber covers 104 at different times to form the vacuum chambers 106.

For the purposes of the following discussion, a device having six chamber covers 104 and ten platens 102 is discussed. However, the present invention may be readily utilized on varying numbers of platens 102 and chamber covers 104, including equipment 100 having equal numbers of platens 102 and chamber covers 104. Where the number of platens 102 does not equal the number of chamber covers 104, the resultant combinations are the result of each platen 102 and chamber cover 104 being used sequentially, such that for the six chamber cover and ten platen configuration under discussion, the first six chamber covers would be matched with the first six platens, with the chamber covers then beginning to be re-used starting with the first chamber cover now being matched with the seventh platen, the second chamber cover now being matched with the eighth platen, and so on, with the chamber covers and platens continuing to be used sequentially.

The controller system 128 may preferably be provided with pressure sensors 108, 110, which are configured to determine the vacuum level obtained in any of the vacuum chambers 106 during a vacuum cycle. Where multiple vacuum pumps are used to stage the withdrawal of air from the vacuum chamber, the sensors 108, 110 may be associated with each vacuum pump. For example, where two vacuum pumps 124, 126 are connected sequentially to a vacuum chamber 106 through a slip ring or other channel to allow withdrawal of air from the vacuum chamber 106, a sensor 108 may be provided in a port or passage associated with the first pump 124 to measure the vacuum drawn by the first pump 124 with respect to the chamber 106 in which the product and packaging are present, with sensor 110 being connected with a second stage pump 126.

The system may additionally be provided with additional sensors 112, 114, such as for identifying the particular platen 102 and/or chamber cover 104 in use at the present time. In one embodiment, the system may use optical sensors which detect a feature 132 on a platen 102 designated the number "1" platen, and a feature 134 on a first chamber cover 104, designate that chamber cover as the number "1" chamber cover, with a counter 116 being used to designate successive platens 102 and chamber covers 104 until the platen 102 and/or chamber cover 104 having the visual feature 132, 134 identifying that chamber cover and/or platen as the first chamber and/or platen is detected again. Alternately, where the platen 102 and chamber cover 104 combinations are sequential, the controller system 128 may identify the current platen and chamber cover through a counter 116, i.e., having assigned to the first platen and first chamber cover used an arbitrary value, such as platen number "1" and chamber cover number "1," the present platen and chamber cover can be determined through a counter which increments the platen and chamber cover identifiers each time a platen or chamber cover is used, based on the number of chamber covers 104 and platens 102 present, without recourse to visual sensors or other detection means. Alternately, the individual platens 102 and chamber covers 104 may be uniquely identified, such that records can be maintained across starts and stops of the controller system 128. Where a counter system is used to track specific platens 102 and chamber covers 104, the counters may be indexed by an operator at the start of operations to ensure that platen 102 and chamber cover 104 identities are maintained across different operational periods. In an alternate embodiment, the platen and chamber cover identifying sensors may be visual sensors, which detect visual cues on each platen 102 and chamber cover 104, such as bar code labels, such that a data logger can record the platen 102 and chamber cover 104 identifier so that they can be associated with vacuum readings without use of a counter system.

In addition to the components for identifying platens 102, chamber covers 104, and vacuum levels achieved, the system may be provided with additional sensors for determining operational parameters. A sensor 118 may be used to determine when a platen 102 has product in packaging on the platen 102. This may be accomplished in a number of ways, such as, for example, through a visual sensor which determines disruption of a field of view resultant from the presence of product (i.e., a sensor utilizing a light source and a receiver, where the placement of product between the light source and receiver prevents the light from reaching the receiver), or through the use of a mass sensor which determines from the weight of the platen being weighed whether product is present (i.e., whether the mass of the platen being weighed is greater than the unloaded weight of the platen).

A further sensor 120 may be used to determine timing associated with measuring a vacuum level, such as when ports on a vacuum chamber 106 are located in communication with the vacuum pump 124, 126. In order to create a greater flow processing rate, vacuum chambers 106 may be connected to a vacuum source only during the period when the vacuum chamber is closed with product and packaging. As such, measuring the vacuum drawn at a time other than when the vacuum is applied to the closed vacuum chamber 106 may provide information of little value.

In addition, a sensor 122 may be provided that indicates each time a package is discharged from the vacuum packaging system 100, such that a timing indication may be obtained to allow tracking of packages to downstream locations.

As the process used in multiple vacuum chamber systems leaves some chambers being loaded, some chambers being depressurized, and some vacuum chambers being unloaded, all at the same time, savings can be established by using a common vacuum pump or vacuum pumps for all of the vacuum chambers sequentially, rather than providing one or more vacuum pumps for each and every vacuum chamber. Similarly, the amount of sensing equipment required can also be reduced, by associating the pressure measuring equipment with the vacuum pump, rather than a chamber.

In an embodiment using a single vacuum pump 124, which is sequentially applied to different vacuum chambers 106, measuring the vacuum drawn in a particular vacuum chamber provides information regarding whether an adequate vacuum was drawn for the packaged product, and where the system uses chambers and platens which are not continuously associated with each other, and information regarding the effectiveness of the combination of particular chambers with particular platens.

In such a system, a single vacuum pump 124 may be alternately connected to successive vacuum chambers, with measurement of the vacuum obtained occurring when the vacuum pump 124 is connected to a vacuum chamber, through the use of a pressure sensor 108, 110 placed on the vacuum pump side of the alternating connection with the vacuum chambers 106, such that only a single sensor 108 needs to be implemented.

In an alternate embodiment, the use of a two stage vacuum drawing system, which sequentially connects different vacuum pumps 124, 126 at different times, may be preferred. In such a system, a first sensor 108 could be associated with a port on the first vacuum pump 124, where the port is in communicable connection with a vacuum chamber 106 when connected, and with a second sensor 110 associated with a port on the second vacuum pump 126, where the port is in communicable connection with a vacuum chamber 106 when connected. Thus, the vacuum obtained in the vacuum chamber 106 would be dependent on both the vacuum drawn by the first pump 124, when connected, as well as the second pump 126, when connected. Simply measuring a vacuum level resultant after both vacuum pumps 124, 126 had been connected would potentially provide ambiguous information regarding the source of any deficiencies in the vacuum drawn in a vacuum chamber.

Accordingly, when used with such a system, it is preferred to measure both the vacuum drawn by the first pump 124 and the vacuum drawn by the second pump 126, through which it can inferentially be determined whether a failure to achieve a desired vacuum was the result of one or both of the pumps 124, 126, or of the vacuum chamber 106 itself. Thus, the timing of the measurement is relevant to the meaning of the measurement, and an optical sensor 120 may be used to determine positioning of the vacuum chamber 106, such as when it reaches a first position, at which location the first vacuum pump 124 may be connected to the vacuum chamber. Alternately, a contact sensor or sensors may be utilized to obtain the same information.

Timing for measurement of a second vacuum pump's 126 draw may be established based on the timing information obtained for the first vacuum pump 124 or source, or may be obtained by using a second sensor. Where a single sensor 120 is used, the natural timing of the machinery may be used such that the expected time increments between stations within the machinery may be used to associate the second reading with a particular vacuum chamber, based on the detection obtained for the first position sensor timing.

Furthermore, an additional sensor 122 may be utilized to allow designation of a particular product/packing combination as defective when it is determined that the vacuum level achieved in a vacuum chamber is inadequate for product purposes. As the vacuum packaging equipment 100 typically works on cycles, each having a fixed time increment, or set of established positions, the downstream location of a package can be determined the amount of time which has passed (which may be thought of as using "cycles" for the measure of unit) since an improper vacuum level had been achieved. For example, if a particular product/package combination was packaged in a vacuum chamber at cycle X, and it was known that it took 20 cycles for the product/package combination to reach a diverter, then the package which reached the diverter 20 cycles after the inadequate vacuum was identified could be diverted from the line for recovery. As the production line may not operate in a continuous fashion, and as diverting an acceptable product/packaging unit would not be desired, a sensor 116 may be used to count the number of cycles which have occurred since the unacceptable vacuum achieved determination, to divert the unacceptable product/packaging combination at a time when the actual number of cycles has occurred.

The above system of sensors may be monitored by a programmable logic controller system 128 or other data acquisition system to allow the vacuum achieved to be measured, recorded, and correlated with individual chamber/platen combinations. The programmable logic controller system 128 or other data acquisition system may have additional capabilities which enable the system to actively affect product/packaging combinations downstream, such as when an inadequate vacuum has been drawn before a package has been sealed, in which case the product package for which the vacuum was inadequate being diverted from the line, such as to a repackaging area.

The system may be operated in either passive or active modes, dependent on the desires of the user. In the case of passive monitoring, capabilities necessary to implement active monitoring may be deleted, such as the components necessary to allow product/packaging components to be diverted from a production line downstream from the vacuum packaging equipment.

Figure 2:
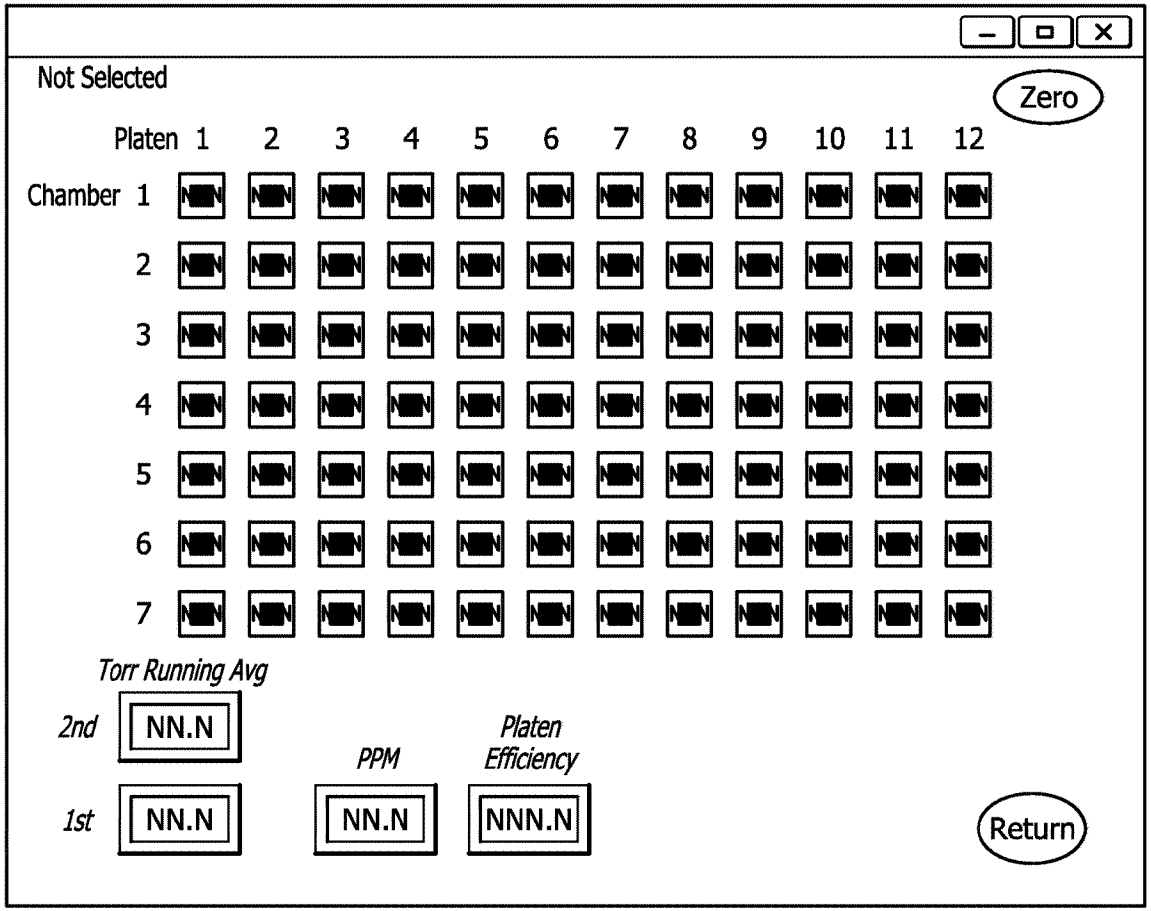
FIG. 2 is a notional display for showing vacuum performance on a seven chamber cover, twelve platen vacuum packaging system according to an embodiment of the present invention.

In a simplest passive monitoring system, the system may record the vacuum levels achieved for individual vacuum chambers associated with a vacuum packaging system. In this simple role, the data may be stored for later review by one or more operators or other maintenance people, such as at the end of the day, to allow determination of proper equipment functioning. The data log may record an identifier for a platen, an identifier for the chamber cover, and/or the vacuum achieved for the platen. Where multiple stages of vacuum are used, the system may record the vacuum achieved in each stage.

Where the system uses a number of chamber covers and platens that are equal, such as a machine using four platens and four chamber covers, a display may be provided for each platen/chamber cover combination. Typically, in a four chamber cover, four platen system, the sequence would join the same platens to the same chamber covers each cycle, such that only four platen/chamber cover combinations would need to be recorded. Where the number of platens and chamber covers differs, such as (for illustrative purposes) a four platen, three chamber cover system, the potential for each platen to be eventually associated with each chamber cover would exist, such that the recording of the data would need to occur with respect to the combinations, i.e., chamber cover "1," platen "1" (or 1,1); chamber cover "2," platen "2" (or 2,2); chamber cover "3," platen "3" (or 3,3); followed by chamber cover "1" being joined to platen "4" (or 1,4); chamber cover "2" being joined to platen "1" (or 2,1), etc. Thus, it can be seen that a matrix such as shown in FIG. 2 is illustrating a seven chamber cover, twelve platen system, can be formed to identify the chamber cover/platen combinations.

The matrix structure can be used as an identifier for each data set (i.e., what chamber cover/platen combination had vacuum applied at what time, and what vacuum level was obtained, such that the data would be sortable based on time, chamber cover, platen, and/or vacuum level achieved, such that trends in performance could be detected and addressed). For example, if the vacuum achieved decreased over time, no matter the platen/chamber cover combination, a problem in the vacuum pump would be indicated. Where the performance decrease occurred only with respect to a particular platen or chamber cover, or particular platen/chamber cover combination, that particular platen/chamber cover or platen/chamber cover combination would be indicated as the potential cause of the decreased performance.

Figure 3:
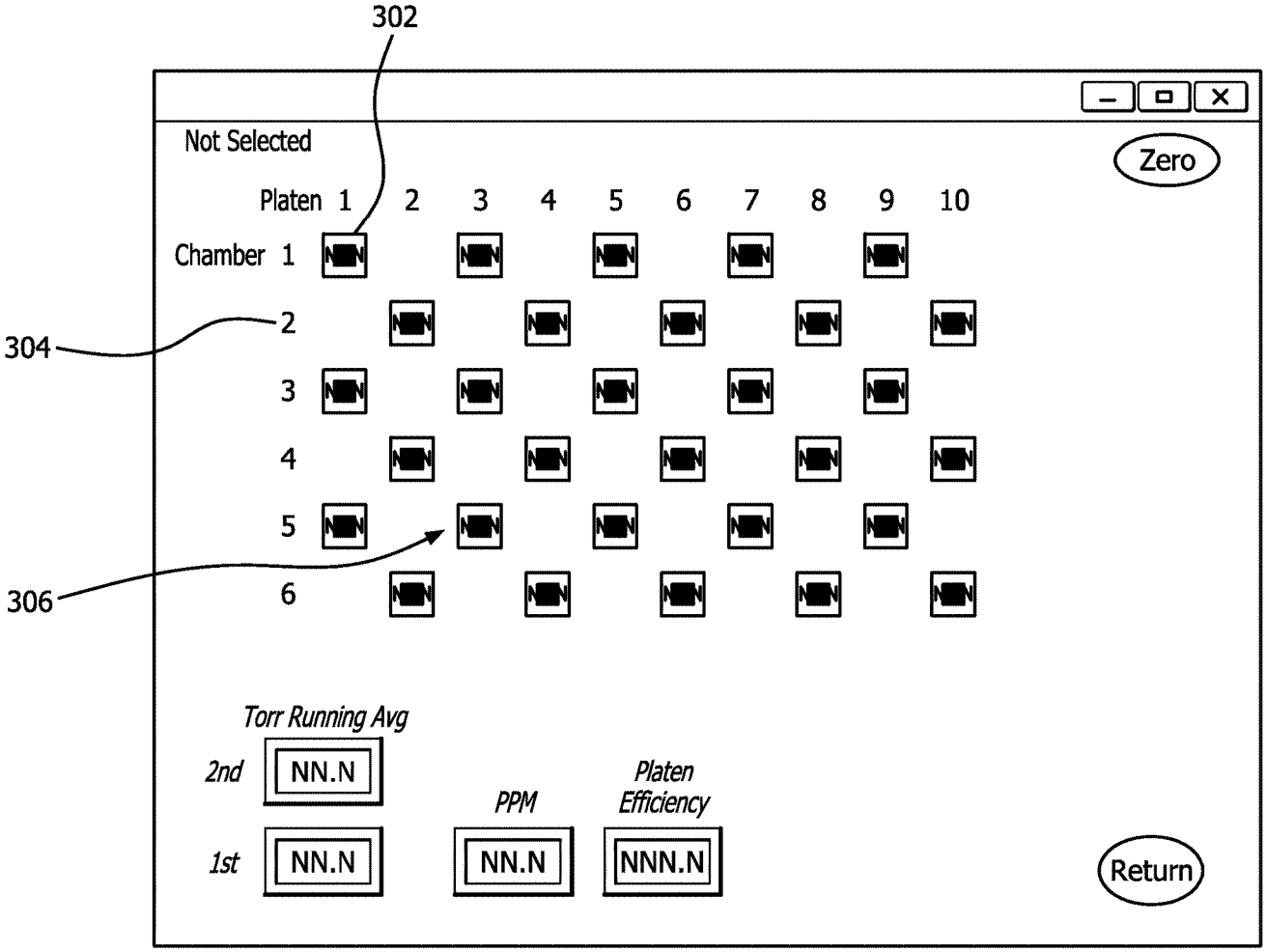
FIG. 3 is a notional display for showing vacuum performance on a seven chamber cover, twelve platen vacuum packaging system according to an embodiment of the present invention.

The controller system 128 may also be provided with a display to allow real-time display of performance to an operator of the vacuum packaging system. In such a system, the display can provide an indication of the performance of the most recent platen/chamber cover combination, in a matrix form, with performance being coded such that deviations from expected performance can be rapidly identified. Such a display is shown in FIG. 3, which illustrates such a display for a ten platen, six chamber cover device. The matrix of potential combinations can be displayed with platens associated with columns 302, and chamber covers 304 associated with rows, such that the combination of platen "3" with chamber cover "5" would have an associated performance indication 306 shown in the fifth row, third column of the matrix. The indication could be as simple as colored block to indicate whether the vacuum achieved was acceptable with respect to packaging requirements. For example, sufficient vacuum could be indicated by a green indication, marginal vacuum by a yellow indication, and insufficient vacuum indicated by a red indication. Numerical data associated could additionally be displayed, such as a value in Torr of the vacuum achieved. Additional performance data associated with the system could also be displayed, such as average vacuum readings across all platen/chamber cover combinations for a given period of time, potentially over multiple vacuum stages, packages per minute being processed information.

As can be seen from the display in FIG. 3, there is a potential that not all matrix positions would be utilized, such as where both the number of platens and chamber covers were even, resulting in matrix positions for combinations which did not occur (such as platen "2" chamber cover "1," platen "4" chamber cover "1") which did not occur could be left blank.

Figure 4:
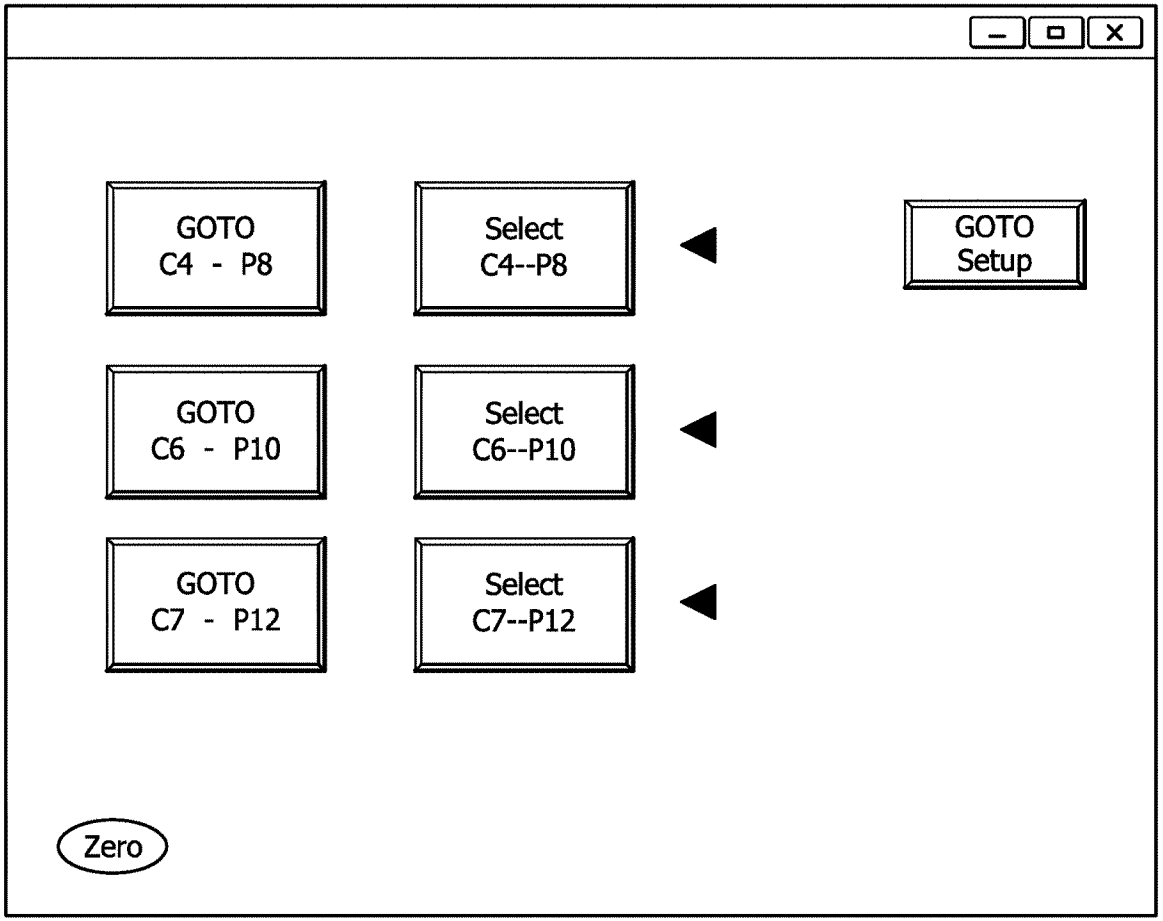
FIG. 4 is a notional display for allowing an operator to identify combinations for which data is desired to be viewed.
Figure 5:
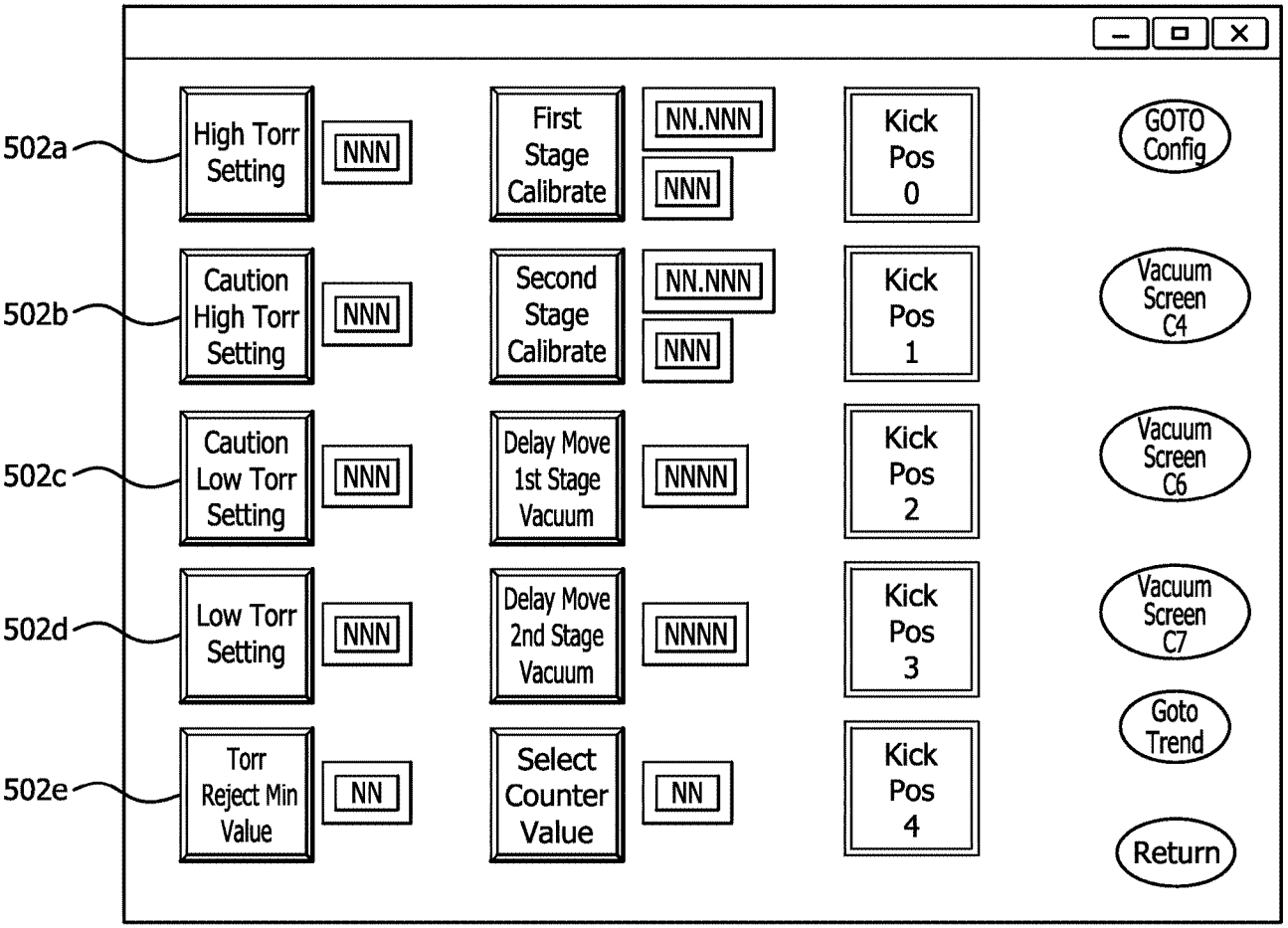
FIG. 5 is a notional display for allowing an operator to set monitoring parameters for a monitoring system according to an embodiment of the present invention.
Figure 6:
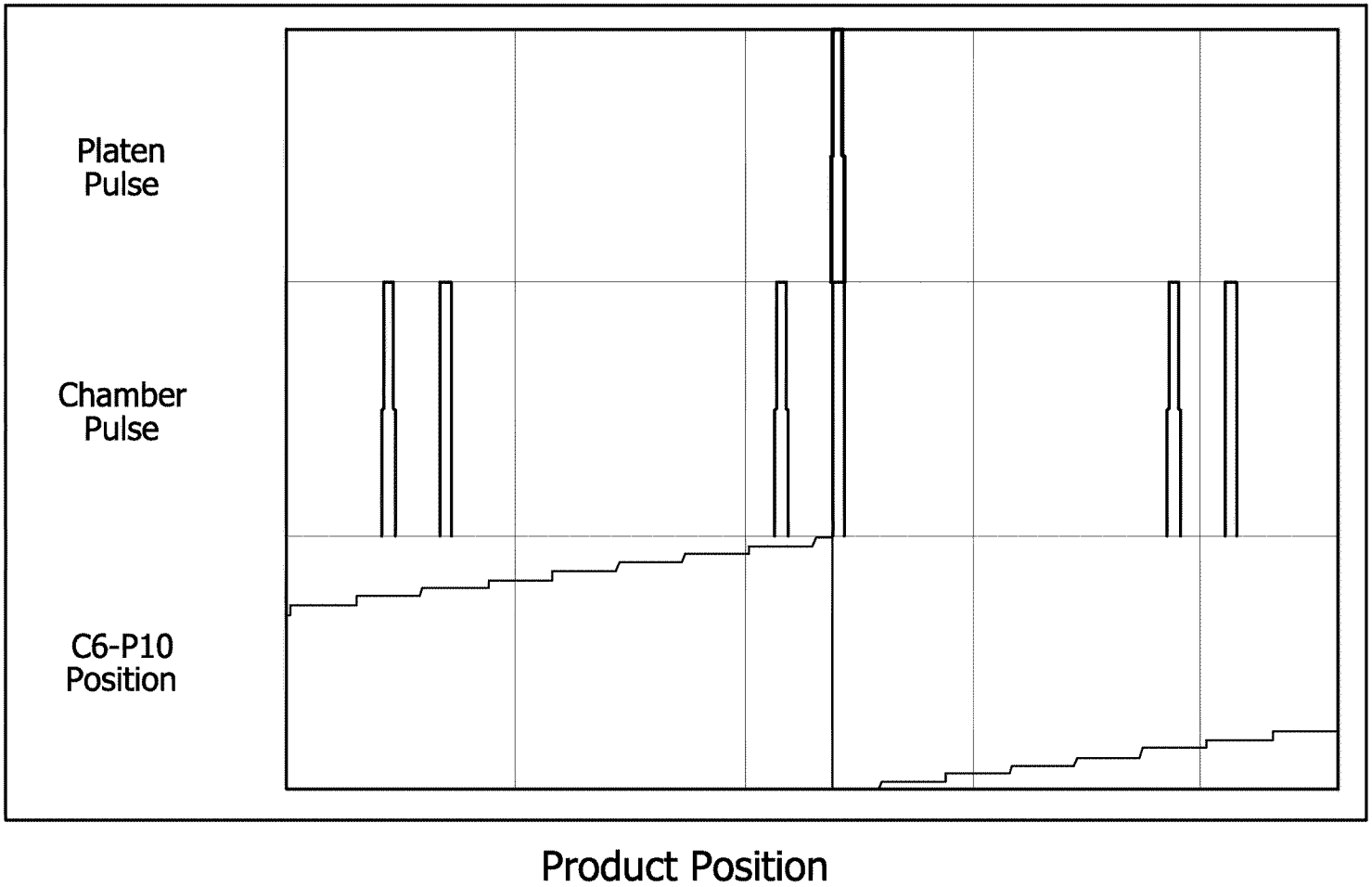
FIG. 6 is a notional display of a product position sensor output for a monitoring system according to an embodiment of the present invention.
Figure 7:
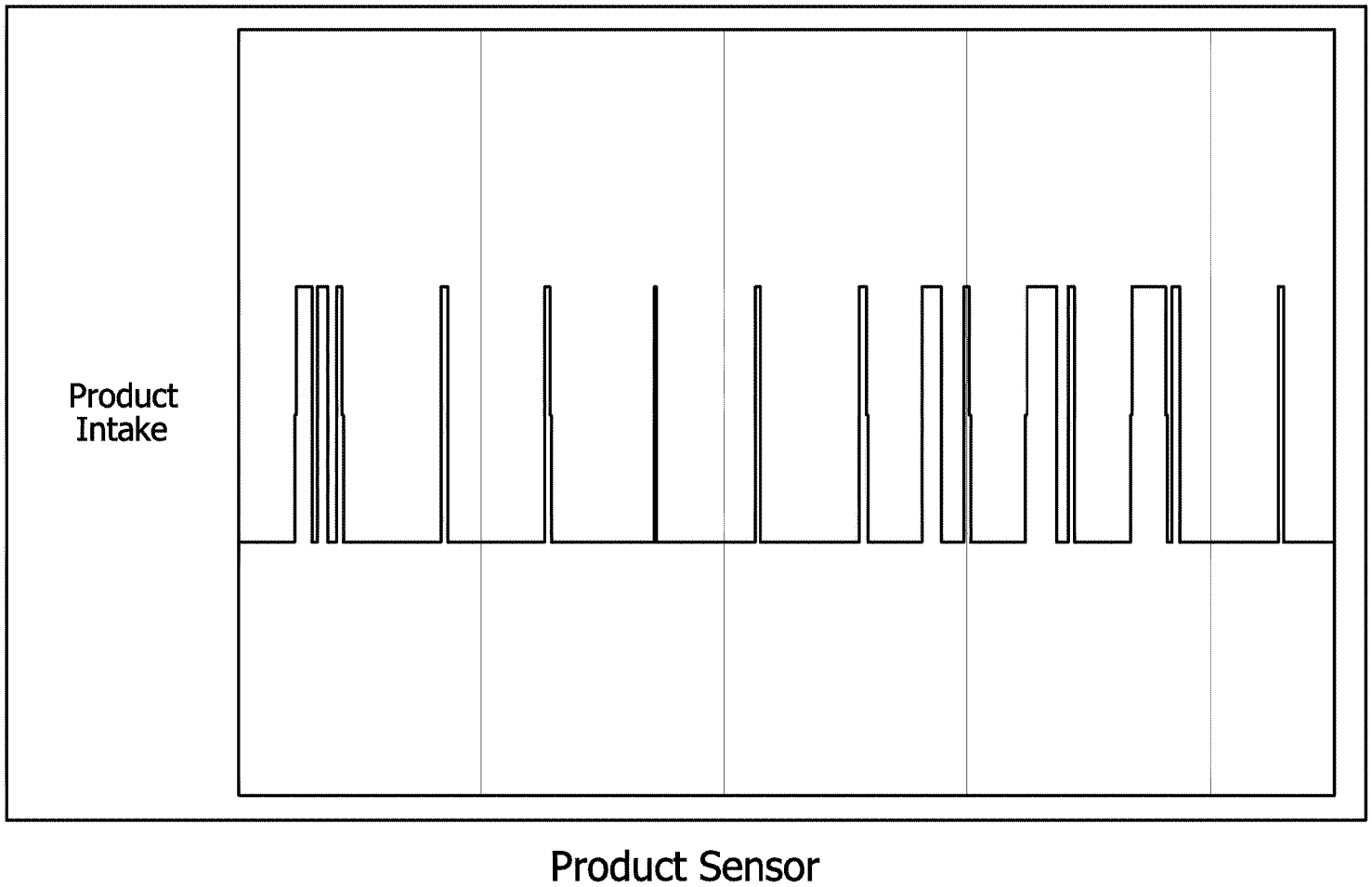
FIG. 7 is a notional display of a product sensor output for a monitoring system according to an embodiment of the present invention.
Figure 8:
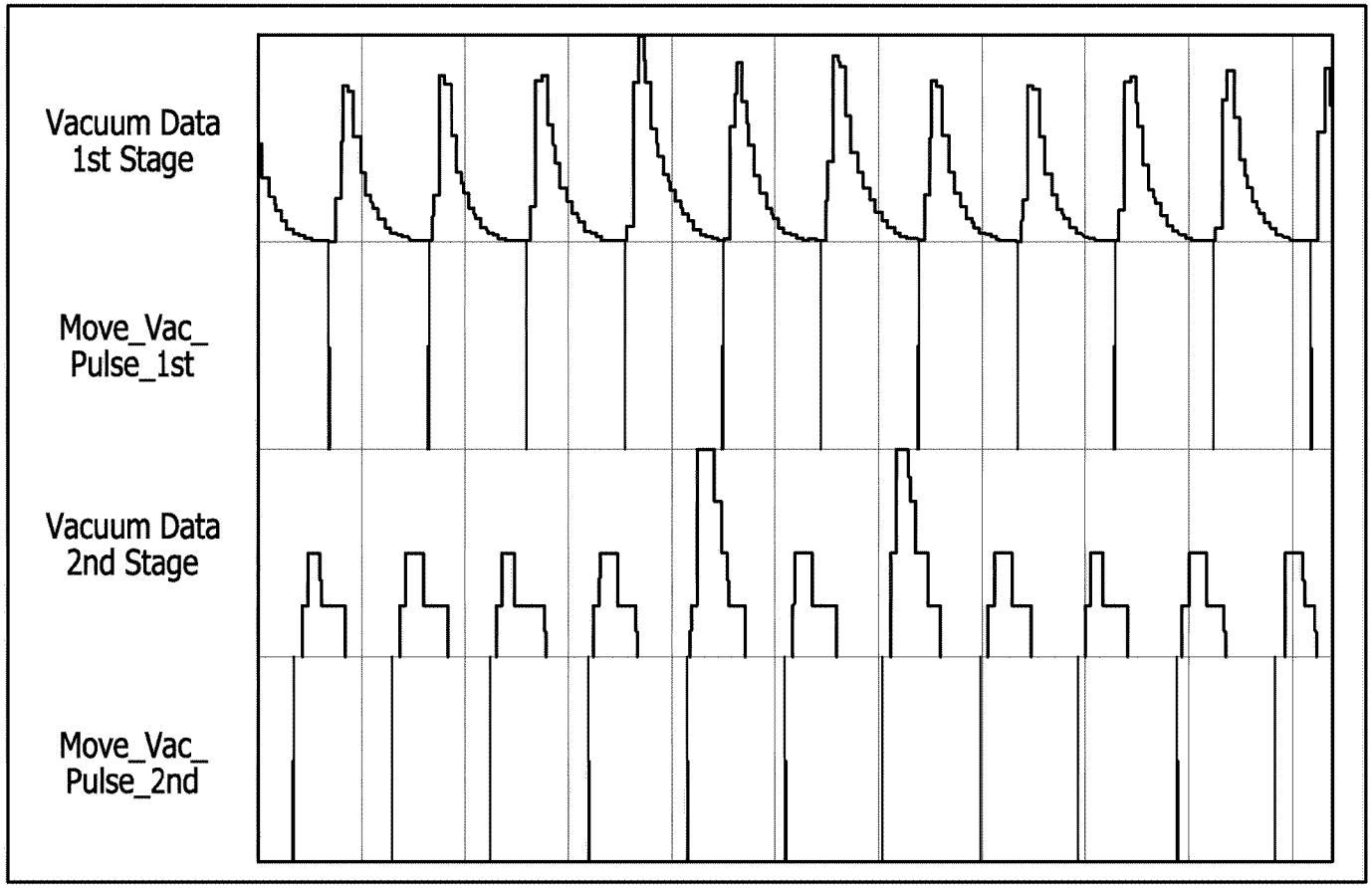
FIG. 8 is a notional display of a vacuum sensor output for a dual stage vacuum pump system according to an embodiment of the present invention.

As shown in FIGS. 4 and 5, interfaces could be provided for setting parameters for performance indications, such as threshold values 502 *a, b, c, d, e*, . . . for acceptable vacuum levels achieved. Additionally, interfaces could be provided to allow an operator to review historical performance for particular chamber/platen combinations, to allow trends to be evaluated. Real time trending information, such as that shown in FIGS. 6, 7, 8 could thus be generated for the operator's perusal, as desired.

In a complete implementation, the system may be implemented such that packages resultant from chamber cover/platen combinations for which an insufficient vacuum was achieved could be diverted to a disposal or repackaging area, based on the vacuum readings obtained. Such a system, again shown in FIG. 1, could use tracking of the particular package for which an insufficient vacuum was achieved to allow a diverter 136 to divert the particular package. Where the system uses a cycle counter 116, which would increment each time a completed package left the vacuum packaging unit 100, the cycle count could be used to determine when the particular package would arrive at a downstream location. For example, it may be known that each package takes ten cycles to reach a downstream diverter 136, that a package for which insufficient vacuum was achieved, would ten cycles later be at the diverter 136. As such, the vacuum measuring implementation could be implemented to implement automated package rejection based on vacuum achieved.

The present invention may be embodied in other specific forms without departing from the spirit or essential attributes of the invention. Accordingly, reference should be made to the appended claims, rather than the foregoing specification, as indicating the scope of the invention.

What is claimed is:

1. A monitoring system for a vacuum packaging machine, the vacuum packaging machine comprising a plurality of platens and chamber covers and a vacuum pump for pumping air from vacuum chambers formed from platens and chamber covers, the monitoring system comprising:

a vacuum sensor being communicably connected with said vacuum chamber, said vacuum sensor measuring a pressure level in a vacuum chamber formed from one of the plurality of platens and chamber covers;

a platen identifier identifying at least one platen being used to form a vacuum chamber to which said vacuum sensor is communicably connected;

a chamber cover identifier identifying at least one chamber cover being used to form the vacuum chamber to which said vacuum sensor is communicably connected; and a controller system recording the vacuum achieved in the vacuum chamber for the at least one platen and chamber cover joined to form the vacuum chamber, wherein the controller system further recording information from the platen identifier and the chamber cover identifier identifying which of the at least one platen and the at least one chamber cover are joined to form the vacuum chamber, wherein differing combinations of platens and chamber covers are possible.

2. The monitoring system according to claim 1, wherein the number of platens and the number of chamber covers is not equal.

3. The monitoring system according to claim 1, wherein the controller system further comprises logic to compare an achieved vacuum level against a predetermined threshold.

4. The monitoring system according to claim 3, further comprising a display displaying a visible indication when said vacuum achieved does not meet said predetermined threshold.

5. The monitoring system according to claim 3, wherein said controller system generating a reject signal when said vacuum achieved does not meet said predetermined threshold.

6. The monitoring system according to claim 1, wherein said controller system records the vacuum achieved in a vacuum chamber for a plurality of platen and chamber cover combinations.

7. The monitoring system according to claim 6, wherein said recorded vacuum achieved in a vacuum chamber for a plurality of platen and chamber cover combinations is displayed to an operator on a display in a matrix pattern.

8. The monitoring system according to claim 1, said vacuum packaging machine further comprising a package sensor determining when a particular platen has a product on the platen.

9. The monitoring system according to claim 8, wherein said controller system further comprises logic to compare an achieved vacuum level against a predetermined threshold, said controller system generating a reject signal when said vacuum achieved does not meet said predetermined threshold, and said monitoring system further comprising a diverter, said diverter diverting a product vacuum packed in a particular platen and chamber cover combination when said controller system generates a reject signal.

10. A vacuum packaging machine for vacuum packaging products, said vacuum packaging machine comprising:

a plurality of platens;

a plurality of chamber covers, said chamber covers being joined to said platens to form vacuum chambers and allowing differing combinations of platens and chamber covers to be associated, the vacuum chambers being able to be formed from differing combinations of platens and chamber covers;

a vacuum source selectively connected to said vacuum chambers;

a vacuum sensor selectively connected to said vacuum chambers;

identifiers affixed to each platen and chamber cover associated with the vacuum packaging machine; and a controller system recording the vacuum achieved in said vacuum chambers when said vacuum source is selectively connected to said vacuum chambers, said controller system further recording information from the identifiers affixed to each platen and chamber cover identifying which platen and which chamber cover comprised the vacuum chamber when the vacuum achieved was recorded.

11. The vacuum packaging machine according to claim 10, wherein said vacuum packaging machine further comprises a package sensor, said package sensor determining when a particular platen has a product on the platen.

12. The vacuum packaging machine according to claim 10, wherein said controller system further comprises logic for comparing said vacuum achieved against a pre-determined threshold.

13. The vacuum packaging machine according to claim 12, further comprising a diverter, said diverter diverting a product when said vacuum achieved in a platen and chamber cover combination does not meet said pre-determined threshold.

14. The vacuum packaging machine according to claim 12, further comprising a display displaying vacuum achieved results for said platen and chamber cover combinations.

15. The vacuum packaging machine according to claim 14, wherein said vacuum achieved results are displayed on a display in a matrix pattern.

16. The vacuum packaging machine according to claim 15, wherein said vacuum achieved results are displayed with coding to indicate whether said vacuum achieved results met said pre-determined threshold.

17. The vacuum packaging machine according to claim 15, further comprising a second vacuum pump selectively connected to said vacuum chambers, and a second vacuum sensor selectively connected to said vacuum chambers, and wherein said controller system records second vacuum levels achieved associated with said vacuum chambers by said second vacuum sensors.

18. The vacuum packaging machine according to claim 17, wherein said controller system further comprises logic for comparing said second vacuum achieved against a second pre-determined threshold.

19. The vacuum packaging machine according to claim 18, wherein said display further displays said second vacuum achieved results for said platen and chamber cover combinations.

* * * * *